United States Patent [19]

Johansson

[11] Patent Number: 4,554,791

[45] Date of Patent: Nov. 26, 1985

[54] APPARATUS FOR CONVEYING LIQUIDS

[75] Inventor: Gustav A. Johansson, Nordborg, Denmark

[73] Assignee: Danfoss A/S, Nordborg, Denmark

[21] Appl. No.: 567,416

[22] Filed: Dec. 30, 1983

[30] Foreign Application Priority Data

Jan. 7, 1983 [DE] Fed. Rep. of Germany ..... 3300297

[51] Int. Cl.[4] ..... F17C 13/00

[52] U.S. Cl. ..... 62/55; 62/185; 62/201; 62/208

[58] Field of Search ..... 62/55, 185, 201, 208, 62/209, 278; 165/2, 14, 27; 141/82

[56] References Cited

U.S. PATENT DOCUMENTS

| | | | |
|---|---|---|---|
| 2,958,205 | 11/1960 | McConkey | 62/55 |
| 2,975,608 | 3/1961 | Morrison | 62/55 |
| 2,976,695 | 3/1961 | Meade | 62/55 |
| 3,256,705 | 6/1966 | Dimentberg | 62/55 |
| 3,802,213 | 4/1974 | Ooka | 62/55 |

*Primary Examiner*—Ronald C. Capossela

*Attorney, Agent, or Firm*—Wayne B. Easton

[57] ABSTRACT

The invention relates to an apparatus for conveying liquids of which the vapor pressure is above atmospheric at ambient temperatures from a storage container to a delivery point, particularly for dispensing refrigerant.

11 Claims, 1 Drawing Figure

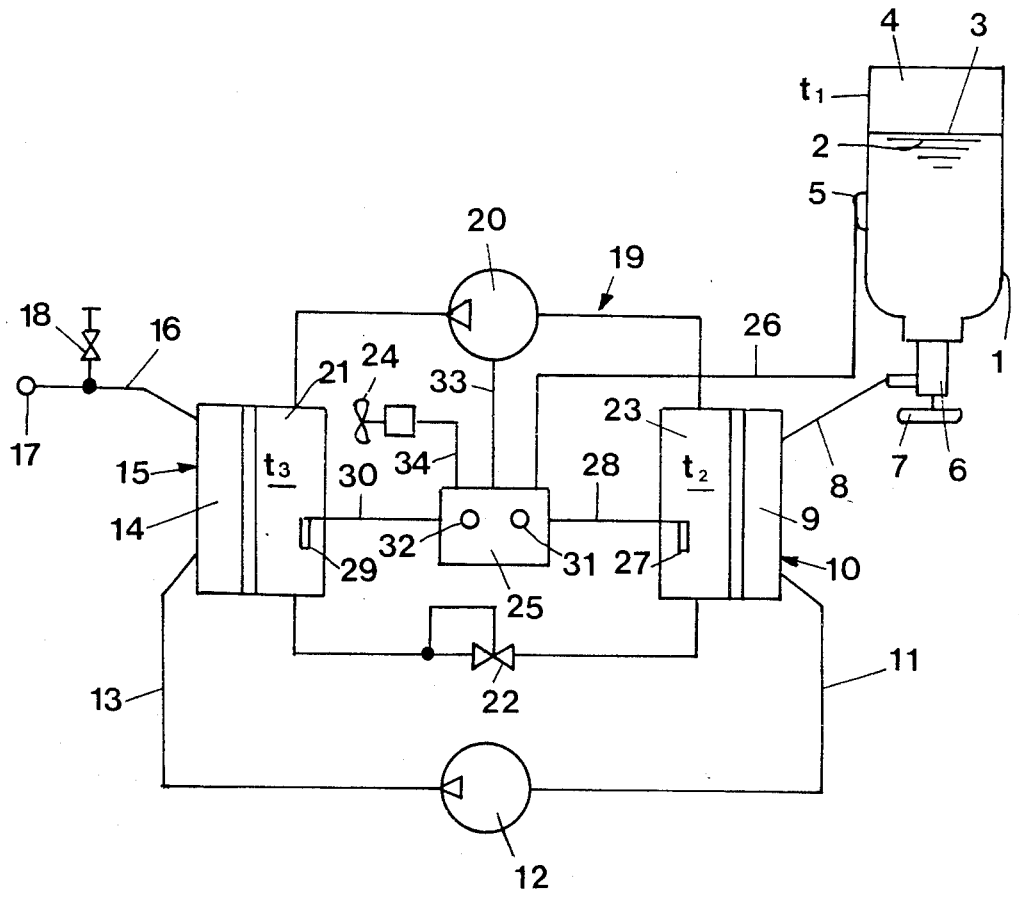
4
3
t1
2
5
20
19
18
16
26
1
21
24
33
23
17
15
t3
30
34
28
t2
8
7
6
14
9
32
29
31
27
10
25
11
13
22
12

APPARATUS FOR CONVEYING LIQUIDS

The invention relates to an apparatus for conveying liquids of which the vapour pressure is above atmospheric at ambient temperature from a storage container to a delivery point, particularly for dispensing refrigerant.

A known apparatus of this kind (DE-AS No. 12 17 232) serves to fill refrigerant to capsules containing a refrigerant compressor. For this purpose, the delivery point is connected to a dispensing cylinder. Conveying of the liquid takes place under the influence of the vapour pressure of the liquid in the container. Since the vapour chamber increases in size during conveying, and refrigerant must therefore be vaporised continuously, the container temperature and thus the vapour pressure will drop. Conveying can therefore be undertaken only at prolonged time intervals or the container must be provided with heating apparatus. However, the latter has the inherent danger of the vapour pressure rising to impermissible values upon overheating and causing the container to burst.

The invention is based on the problem of providing an apparatus of the aforementioned kind in which liquid can be conveyed continuously or at very short intervals and there is no danger of an impermissible pressure build-up.

This problem is solved according to the invention in that a pump between the container and delivery point is preceded by cooling apparatus of which the temperature is held at least somewhat lower than the container temperature.

In this construction, conveying of the liquid is effected not as a result of the vapour pressure but with the aid of a pump. By having the cooling apparatus upstream of it, one ensures that the pump will always be adequately supplied with liquid and therefore functional. If the container is emptied during operation of the pump, the vacated container space is filled with vapour created from the liquid while heat is being withdrawn from the surroundings. The container temperature therefore drops. At the same time, the region of the pump is heated through its operation. If no cooling apparatus were available, the result would be that liquid vaporises in the vicinity of the pump during the standstill periods and condenses in the vicinity of the container. Since liquid pumps exert no or only a limited suction effect on vapour, no liquid would be conveyed when the pump is next started. However, if the pump is preceded by the cooling apparatus, impermissible increase in the temperature of the liquid in the pump region is obviated. During standstill periods, the liquid in the region of the cooling apparatus is held at a temperature which ensures that there will be no vaporisation at this point. During the next start, therefore, sufficient liquid is available to the suction side of the pump to permit conveying to commence without difficulties.

With particular advantage, the pump is a hermetically sealed gear pump with a drive by way of a magnetic clutch. Such a pump is known per se. In the present case it ensures that no atmospheric air can enter the liquid and detrimentally influence same. Hermetic sealing is possible with the aid of the magnetic clutch.

Desirably, the cooling apparatus is disposed at the same level as or higher than the inlet of the pump. It is therefore not necessary to suck liquid through a particular height, which would create additional vacuum enhancing the formation of vapour; instead, the liquid is reliably available at the pump inlet.

The conduit section between the cooling apparatus and the pump may also be thermally insulated. This prevents a temperature rise in the cooled liquid in its travel to the pump and thus the formation of vapour.

In most cases, it is sufficient if the cooling apparatus is held at a temperature substantially 0.5° C. below the container temperature. This generally suffices for preventing vaporisation of the liquid in the vicinity of the pump. One must, however, ensure that this low temperature difference is always maintained, i.e. even if the container temperature drops.

It is very favourable for the cooling apparatus to be formed by the evaporator of a refrigeration plant. Such a refrigeration plant can be easily regulated. The temperature of the cooling apparatus can therefore be readily made to follow the temperature of the container.

In a further embodiment of the invention, the pump can be followed by a heating apparatus. In this way, every desired operating pressure can be produced and, for example, the dispensing apparatus of a filling plant can be operated so that the particularly desired filling is achieved. One can do this independently of the exterior temperature, i.e. irrespective of the time of the year. In particular, the heat previously withdrawn from the liquid can be returned to it.

Further, the heating apparatus may be formed by the condenser of the refrigeration plant. The refrigeration plant can then serve two purposes. There is a balanced economy of heat.

From a constructional point of view, a temperature regulating apparatus is suggested which detects the temperature of the container with a first sensor and the temperature of the cooling apparatus with a second sensor and also regulates the amount of refrigeration in relation to the difference. In this way, one ensures that the temperature of the cooling apparatus will always be below the temperature of the container. As a temperature signal for the cooling apparatus, one can also employ the evaporator pressure when use is made of the evaporator of a refrigeration plant.

In particular, the temperature regulating apparatus may switch the compressor of the refrigeration plant on and off. This results in particularly simple regulation.

Further, the temperature regulating apparatus may regulate the operation of a fan associated with the condenser. It is therefore possible to regulate the amount of heat to be supplied to the liquid behind the pump and prevent overheating of the condenser.

Preferably, a ventilating apparatus is provided near the delivery point. When connecting a new container, therefore, liquid can first be led up to the pump with the aid of the vapour pressure and, after switching the pump on, up to the ventilating apparatus, the air contained in the installation being pushed out. The ventilating apparatus is thereupon closed, for example with the aid of a ventilating screw, and the conveying step proper can commence.

The invention will now be described in more detail with reference to a preferred example illustrated in the drawing. The drawing is a circuit diagram of an apparatus according to the invention for conveying liquid.

A container 1 is partially filled with liquid 2. Above the surface 3, there is a vapour chamber 4. The vapour is at a pressure depending on the temperature $t_1$ of the container. This temperature, in turn, depends on the ambient temperature and how much heat is extended from the container wall by the vaporisation of liquid 2. The temperature can be detected with the aid of a sensor 5.

The container 1 is provided with a valve 6 which can be open with the aid of a hand wheel 7. The valve 6 communicates by way of a conduit 8 with a chamber 9 of a cooling apparatus 10. Another conduit section 11 leads to a delivery point 17 by way of a liquid pump 12, a conduit section 13, the chamber 14 of a heating apparatus 15 and a further conduit section 16. Near the delivery point 17 there is a ventilating apparatus 18, for example with a ventilating screw. The pump 12 is a gear pump of which the driven gear is connected by a magnetic clutch to an electric motor. The chamber 9 of the cooling apparatus 10 is disposed above the pump 12. The conduit section 11 is short and carries thermal insulation.

A refrigeration plant 19 comprises a compressor 20, a condenser chamber 21, an expansion valve 22 and an evaporator chamber 23. The evaporator chamber 23 is a heat-exchange contact with the chamber 9 of the cooling apparatus 10. The condenser chamber 21 is in heat-exchange relationship with the chamber 14 of the heating apparatus 15. The condenser can be additionally cooled with the aid of a fan 24.

A temperature regulating apparatus 25 communicates with the sensor 5 at the container 1 by way of a conduit 26. The evaporator temperature $t_2$ is detected with the aid of a sensor 27 and notified to the temperature regulating apparatus 25 by way of a conduit 28. Similarly, the temperature $t_3$ of the condenser 21 is detected by a sensor 29 and notified to the temperature regulating apparatus 25 by way of a conduit 30. A first desired value setting apparatus 31 permits the temperature difference $t_1-t_2$ to be set to a predetermined value, e.g. 0.5° C. A second desired value setting apparatus 32 permits the condenser temperature $t_3$ to be set to a value which is favourable for the delivery of the liquid.

In operation, the pump 12 is driven continuously or intermittently. Liquid 2 is sucked out of the container 1 and cooled in the cooling apparatus 10. The cooling is selected to be such that the conduit 11 and chamber 9 remain filled with liquid even during standstill of the pump. Evaporation takes place exclusively in the chamber 4. During the next start, the pump 12 will therefore be certain to deliver liquid. The temperature regulating apparatus 25 intermittently operates the compressor 20 by way of the conduit 33 so that the temperature $t_2$ of the cooling apparatus 10 is always 0.5° C. lower than the container temperature $t_1$. The fan 24 is so actuated by the temperature regulating apparatus 25 by way of a conduit 34 that the heating apparatus 15 has a predetermined temperature and appropriately heats the liquid conveyed by the pump.

The delivery point 17 can for example be connected to a filling station for the capsules of hermetically encapsulated refrigerant compressors. In this case, the container 1 will contain a refrigerant.

However, the delivery point 17 can also be connected to a gas burner which is operated with liquid gas contained in the container 1. In this case, a conveying apparatus according to the invention is of particular interest if the container is disposed in cold surroundings beyond the building being heated.

I claim:

1. Apparatus for conveying liquids of which the vapour pressure is above atmospheric at ambient temperature from a storage container to a delivery point, comprising, a storage container, pumping means, fluid conduit means between said storage container and said pumping means having a heat exchange section, said heat exchange section including cooling passage means for receiving a cooling medium, cooling apparatus for supplying a cooling medium to said cooling passage means, temperature sensor means for sensing temperatures of said storage container and said cooling passage means of said heat exchange section, and temperature regulating apparatus responsive to said temperature sensor means for operating said cooling apparatus to maintain the temperature of fluid in said cooling passage means of said heat exchange section a predetermined amount cooler than said storage container.

2. Apparatus according to claim 1 wherein said pumping means is a hermetically sealed gear pump, and magnetic clutch means for driving said pump.

3. Apparatus according to claim 1 wherein said cooling apparatus is disposed at a level at least as high as the inlet of said pumping means.

4. Apparatus according to claim 1 wherein said fluid conduit means between said heat exchange section and said pump is thermally insulated.

5. Apparatus according to claim 1 wherein said predetermined amount is on the order of 0.5° C.

6. Apparatus according to claim 1 including a refrigeration plant having an evaporator which comprises said cooling apparatus.

7. Apparatus according to claim 1 including discharge fluid conduit means connected to the outlet of said pumping means and having a discharge outlet, said discharge fluid conduit means having a second heat exchange section, and heating apparatus for heating fluid in said second heat exchange section.

8. Apparatus according to claim 7 including ventilating apparatus provided near said discharge outlet of said discharge fluid conduit means.

9. Apparatus according to claim 7 including a refrigeration plant having a condenser which comprises said heating apparatus.

10. Apparatus according to claims 1 and 9 wherein said refrigeration plant has a compressor, said temperature regulating apparatus operating in a mode wherein said compressor is switched on and off.

11. Apparatus according to claim 9 including fan means for said condenser and second temperature sensor means for sensing temperatures at said second heat exchange section, said temperature regulating apparatus being responsive to said second temperature sensor means and being operable to maintain a predetermined temperature at said second heat exchange section by controlling the heat output of said condenser via said fan means.

* * * * *